US007372206B2

(12) United States Patent
Inoue et al.

(10) Patent No.: US 7,372,206 B2
(45) Date of Patent: May 13, 2008

(54) GAS DISCHARGE PANEL SUBSTRATE ASSEMBLY HAVING PROTECTIVE LAYER IN CONTACT WITH DISCHARGE SPACE, AND AC TYPE GAS DISCHARGE PANEL HAVING THE ASSEMBLY

(75) Inventors: Kazunori Inoue, Kawasaki (JP); Shigeo Kasahara, Kawasaki (JP); Koichi Sakita, Kawasaki (JP); Osamu Toyoda, Kawasaki (JP); Minoru Hasegawa, Kawasaki (JP); Hideki Harada, Kawasaki (JP); Keiichi Betsui, Kawasaki (JP)

(73) Assignees: Fujitsu Limited, Kawasaki (JP); Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 10/627,727

(22) Filed: Jul. 28, 2003

(65) Prior Publication Data

US 2004/0027072 A1 Feb. 12, 2004

(30) Foreign Application Priority Data

Aug. 6, 2002 (JP) ..... 2002-228725

(51) Int. Cl.
*H01J 17/49* (2006.01)

(52) U.S. Cl. ..... 313/586; 313/582

(58) Field of Classification Search ..... 313/582–587
See application file for complete search history.

(56) References Cited

U.S. PATENT DOCUMENTS

| | | | | |
|---|---|---|---|---|
| 5,454,861 | A | 10/1995 | Hasegawa et al. | 106/2 |
| 6,559,598 | B2 * | 5/2003 | Justel et al. | 313/587 |
| 6,611,099 | B1 * | 8/2003 | Murata et al. | 313/582 |
| 6,650,063 | B2 * | 11/2003 | Uemura et al. | 315/169.4 |
| 2001/0005115 | A1 * | 6/2001 | Busio et al. | 313/586 |
| 2001/0022498 | A1 | 9/2001 | Yoo | 313/582 |
| 2002/0121861 | A1 * | 9/2002 | Katou et al. | 313/587 |
| 2003/0030375 | A1 * | 2/2003 | Nakada et al. | 313/582 |
| 2003/0030377 | A1 * | 2/2003 | Hirano et al. | 313/587 |
| 2004/0075388 | A1 * | 4/2004 | Miyashita et al. | 313/586 |

FOREIGN PATENT DOCUMENTS

| | | |
|---|---|---|
| EP | 0881657 A2 | 12/1998 |
| EP | 1085554 A1 | 3/2001 |
| EP | 1221708 A2 | 7/2002 |
| EP | 1237175 A2 | 9/2002 |

(Continued)

OTHER PUBLICATIONS

Busio et al., "Sol-gel dielectric layer for PDP front plate", Philips Research Laboratories, Asia Display/IDW '01, pp. 1753-1754 (in English).

*Primary Examiner*—Vip Patel
(74) *Attorney, Agent, or Firm*—Staas & Halsey LLP

(57) ABSTRACT

The present invention provides that a gas discharge panel substrate assembly comprising: electrodes formed on a substrate, a dielectric layer covering the electrodes, and a protective layer covering the dielectric layer and in contact with a discharge space, wherein the protective layer includes MgO and at least one compound selected from the group consisting of an Al compound, a Ti compound, a Y compound, a Zn compound, a Zr compound, a Ta compound and SiC.

11 Claims, 6 Drawing Sheets

FOREIGN PATENT DOCUMENTS

| | | | |
|---|---|---|---|
| EP | 1258902 | A2 | 11/2002 |
| JP | 56-61739 | | 5/1981 |
| JP | 9-102280 | | 4/1997 |
| JP | 11-339665 | | 12/1999 |
| JP | 2001-15037 | | 1/2001 |
| JP | 2001-226762 | | 8/2001 |
| JP | 2002-150953 | | 5/2002 |
| JP | 2002-170494 | | 6/2002 |

* cited by examiner 31
32
31
3
4
12

GAS DISCHARGE PANEL SUBSTRATE ASSEMBLY HAVING PROTECTIVE LAYER IN CONTACT WITH DISCHARGE SPACE, AND AC TYPE GAS DISCHARGE PANEL HAVING THE ASSEMBLY

CROSS-REFERENCE TO RELATED APPLICATION

This application is related to Japanese application No. 2002-228725 filed on Aug. 6, 2002, whose priority is claimed under 35 USC § 119, the disclosure of which is incorporated by reference in its entirety.

BACKGROUND OF THE INVENTION

1. Field of the Invention

The present invention relates to a gas discharge panel substrate assembly, a production method therefore and an AC type gas discharge panel.

2. Description of Related Art

There have been reported on various types of gas discharge panels, among which an AC type plasma display panel (PDP) of a three-electrode surface discharge structure has been introduced to the market.

FIG. 5 shows a schematic perspective view of a structure of a PDP on the market. The PDP is of a structure in which a front glass substrate 1 and back glass substrate 2 are adhered to each other. Provided on the front glass substrate 1 are display electrodes 3 constituted of transparent electrodes 31 and bus electrodes 32 and the display electrodes 3 are covered with a dielectric layer 4. Further formed on the dielectric layer 4 is a protective layer 5 made of a MgO layer with a high secondary electron emission coefficient. Address electrodes 6 are provided on the back glass substrate 2 so as to intersect with the display electrodes at right angles. Barrier ribs 7 are provided between the address electrodes 6 in order to define light emitting regions and phosphors 8 for red, green and blue are coated on the address electrodes 6 in the respective regions divided by the barrier ribs 7. Ne—Xe gas is sealed in the interior of a space formed by adhering the front glass substrate 1 and the back glass substrate 2 to each other.

FIG. 6 shows a state of a discharge cell in discharge as viewed in section. A voltage is applied between the display electrodes 3 each including a pair of two electrodes X and Y to form an electric field in a discharge space and to thereby excite Xe and generate gas discharge 9 and vacuum ultraviolet 10 is released therefrom. The ultraviolet 10 strikes the phosphor 8 to emit visible light 11. The discharge cell acts as a display by controlling the vacuum ultraviolet 10 in the electric field in the interior thereof. On this occasion, the vacuum ultraviolet 10 is directed to not only the phosphor 8 but also the front glass substrate 1. The protective layer (MgO layer) 5 and the dielectric layer 4 are formed on the front glass substrate 1 sequentially in the order starting at the discharge surface and since MgO passes a wavelength portion (165 nm or more) of the vacuum ultraviolet therethrough, part of the ultraviolet 10 reaches as far as the dielectric layer 4. In FIG. 6, the reference numbers 2 and 6 are the same as those in FIG. 5 in meaning.

As a method for forming a dielectric layer for use in a PDP, generally known is a method in which it is formed by dispersing frit glass. The frit glass is provided as a paste obtained by dispersing a glass component into a vehicle made of ethyl cellulose resin as a main component. The frit glass in this form is coated on a substrate by printing and is baked to thereby burn out the resin component with the result of formation of a dielectric layer made of a glass component as a main component. Furthermore, as methods for forming a dielectric layer more suitable for mass production in recent years, there have been proposed: a method in which frit glass in the shape of a sheet obtained by dispersing frit glass in acrylic resin or the like is adhered and baked and a method to use vapor phase film formation such as a CVD method.

SUMMARY OF THE INVENTION

The present invention has been made by focusing attention on such a problem, and it is an object of the present invention to provide a gas discharge panel substrate assembly and a gas discharge panel causing no phosphor degradation phenomenon and production methods therefore.

The present invention provides that a first gas discharge panel substrate assembly comprising: electrodes formed on a substrate, a dielectric layer covering the electrodes, and a protective layer covering the dielectric layer and in contact with a discharge space, wherein the protective layer includes MgO and at least one compound selected from the group consisting of an Al compound, a Ti compound, a Y compound, a Zn compound, a Zr compound, a Ta compound and SiC.

Furthermore, the present invention provides that gas discharge panel substrate assembly comprising: electrodes formed on a substrate, a dielectric layer covering the electrodes, an intermediate layer covering the dielectric layer, and a protective layer covering the intermediate layer and in contact with a discharge space, wherein the protective layer includes MgO and the intermediate layer includes at least one compound selected from the group consisting of an Al compound, a Ti compound, a Y compound, a Zn compound, a Zr compound, a Ta compound and SiC.

Moreover, according to the present invention, a production method for a gas discharge panel substrate assembly is provided, in which the dielectric layers of the first and second gas discharge panel substrate assemblies are formed with one of a CVD method, a plasma CVD method and a method in which a frit glass in the shape of a sheet is adhered on a substrate, followed by baking.

Besides, according to the present invention, a production method for a gas discharge panel substrate assembly is provided, in which the intermediate layer of the second gas discharge panel substrate assembly is formed with one of a vacuum evaporation method, a CVD method, a plasma CVD method, a sol-gel method and a binder method.

Furthermore, according to the present invention, a production method for a gas discharge panel substrate assembly is provided, in which the intermediate layer and the dielectric layer of the second gas discharge panel substrate assembly are continuously formed with a CVD method or a plasma CVD method.

Moreover, according to the present invention, a production method for a gas discharge panel substrate assembly is provided, in which the intermediate layer and the protective layer of the second gas discharge panel substrate assembly are continuously formed with a vacuum evaporation method.

Besides, according to the present invention, an AC type gas discharge panel is provided that uses the first or second gas discharge panel substrate assembly as a gas discharge panel substrate assembly in the front side.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
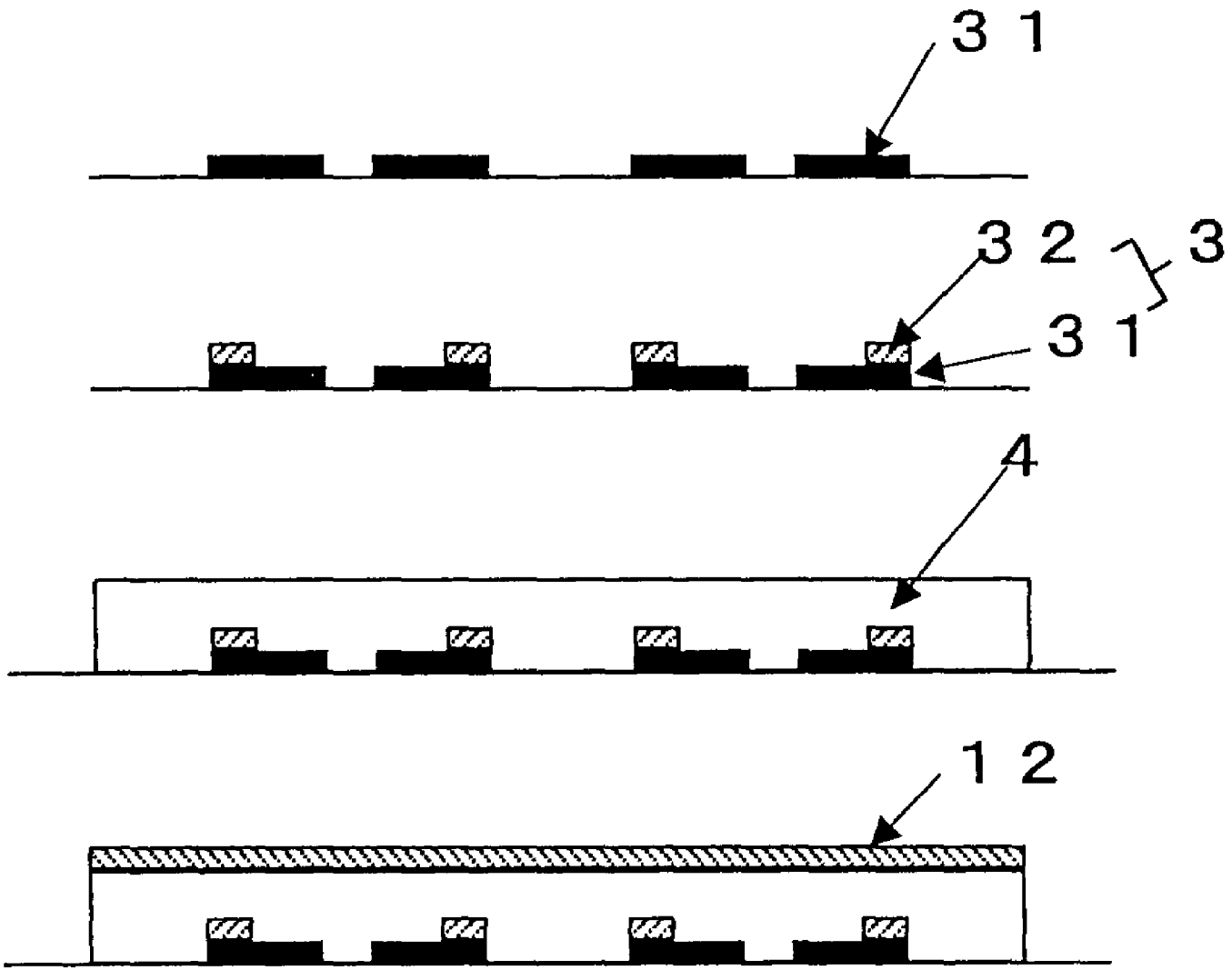
FIGS. 1(*a*) to 1(*d*) are schematic sectional views showing process steps from formation of the gas discharge panel substrate assembly of the present invention.

The inventors of the present invention have studied on a relationship between a method for forming a dielectric layer and a chromaticity of a PDP. As a result, it has been found that anomaly in chromaticity occurs in a case where a dielectric layer is formed with the method using frit glass in the shape of a sheet or the vapor phase film formation method such as a Plasma Enhanced CVD (PECVD) method. To be concrete, dielectric layers were formed in formation conditions shown in Table 1, thereafter a protective layer made of a MgO layer was formed by evaporation to a thickness of 1.0 μm and a PDP was formed in an ordinary process, followed by a display quality test on the PDP.

TABLE 1

| Frit paste | Sheet frit | PECVD-$SiO_2$ |
|---|---|---|
| Printing was performed on a glass substrate, after formation of electrodes, with a paste obtained by adding an ethyl cellulose binder to frit glass and the glass substrate with the print was baked in a conveyor type baking furnace under a heating program of 120 min at 350° C. and then 30 min at 600° C. to form a dielectric layer of 30 μm in thickness. | A sheet obtained by adding an acrylic binder to frit glass is adhered on a glass substrate after formation of electrodes thereon and the glass substrate with the sheet was baked in a conveyor type baking furnace under a heating program of 240 min at 350° C. and then 60 min at 600° C. to form a dielectric layer of 30 μm in thickness. | After formation of electrodes the glass substrate, $SiO_2$ is formed as a dielectric layer on a glass substrate to a thickness of 5 μm in a parallel plate type PECVD apparatus under conditions of feeding $SiH_4$ at a flow rate of 900 sccm, $N_2O$ at a flow rate of 9000 sccm, an RF output at 2.0 kW, a temperature at 400° C. and a pressure at 3.0 Torr. |

White chromacity coordinates of a PDP under the conditions for forming a dielectric layer using the frit paste were (0.300, 0.300) in the CIE standard calorimetric system, while being (0.310, 0.285) in a case where the sheet frit was used and furthermore, the coordinates were also (0.320, 0.280) in a case of the PECVD-$SiO_2$ as well, the two latter of which display a reddish white color. This anomaly in chromaticity was found to be caused by degradation in green phosphor and a shift in chromaticity coordinates to follow, as a result of a study conducted by the inventors.

It is inferred that discharge generated during a display test causes gas release from a dielectric layer formed with a sheet frit or PECVD and in turn the gas degrades phosphor.

A gas source can be inferred to be a material, having a hydrocarbon bond, and remained in the layer without being burned out in the baking since the sheet layer prior to the formation of a dielectric layer obtained by using the sheet frit contains much of an organic component. Likewise, in the PECVD method, the source can be inferred to be a material having bonds of hydrogen with silicon and/or carbon such as $SiH_4$ gas or $Si(OC_2H_5)_4$ remaining in the layer as a material not reacted due to incomplete decomposition of a process raw gas. It is thought that the materials as the gas source are decomposed under an influence of ultraviolet generated by discharge to release hydrocarbon or hydrogen gas, and the gases pass through the MgO layer to then come out into a discharge space and degrade phosphor. The gases are activated by discharge so as to have a reducing ability; therefore, the activated gases are thought to reduce the protective layer (MgO). The reduced protective layer is colored and therefore deteriorated in transmittance. As the results, a luminance is thought to be degraded during panel display, causing a shift in chromaticity.

The present invention has, to be concrete, one of features thereof that a protective layer has an ultraviolet shielding function (a first gas discharge substrate assembly) or alternatively, that an intermediate layer having an ultraviolet shielding function is inserted between a dielectric layer and a protective layer (a second gas discharge substrate assembly). The ultraviolet shielding function means a function capable of shielding ultraviolet having 200 nm or less in wavelength mainly.

In the first gas discharge panel substrate assembly, the protective layer, covering the dielectric layer, and in contact with a discharge space is made of MgO for protecting the dielectric layer from a discharge electric field and at least one compound selected from the group consisting of an Al compound, a Ti compound, an Y compound, a Zn compound, a Zr compound, a Ta compound and SiC having the ultraviolet shielding function.

As Al compounds, there are exemplified: alumina, aluminum nitride and others, as Ti compounds, there are exemplified: titania, titanium nitride and others, as Y compounds, there are exemplified: yttrium oxide, yttrium nitride and others, as Zn compounds, there are exemplified: zinc oxide, zinc nitride, zinc sulfide and others, as Zr compounds, there are exemplified: zirconium oxide, zirconium nitride and others and as Ta compounds, there are exemplified: tantalum oxide and others.

The compound having the ultraviolet shielding function is preferably selected from the group consisting of $Al_2O_3$ (alumina), AlN, $TiO_2$ (titania), $Y_2O_3$ (yttrium oxide), ZnO (zinc oxide), $ZrO_2$ (zirconium oxide), $Ta_2O_5$ (tantalum oxide) and SiC. Bandgaps of these compounds described above are shown in the following Table 2.

TABLE 2

| | Bandgaps (eV) |
|---|---|
| MaO | 8 |
| $Al_2O_3$ | 7.4 |
| AlN | 3.8 |

TABLE 2-continued

| | Bandgaps (eV) |
|---|---|
| $TiO_2$ | 3.0 |
| $Y_2O_3$ | 2.43 |
| ZnO | 3.2 |
| ZnS | 3.7 |
| $ZrO_2$ | 5.16 |
| $Ta_2O_5$ | 4.2 |
| SiC | 3 |

Compounds having a bandgap of 6.2 eV or less among the compounds described above are preferably used since the compounds exert a vacuum ultraviolet (VUV) shielding effect.

A mixing ratio of MgO and the compound having the ultraviolet shielding function is different according to a kind of a compound in use and the ratio is preferably in the range of from 95 to 85, to 5 to 15 in wt %. If a percentage of the compound having the ultraviolet shielding function is less than 5 wt %, it is not preferably since the ultraviolet shielding effect is reduced, while if the percentage of the compound is more than 15, it is not preferably either since a secondary electron emission ratio is decreased.

No specific limitation is imposed on a thickness of the protective layer as far as a prescribed function is exerted, but it is preferably in the range of form 0.5 to 1.5 μm.

No specific limitation is imposed on a method for forming a protective layer but any of known methods in the technical field pertaining to the present invention can be used. There can be exemplified: a CVD method, a sputter method and a vacuum or an atmospheric evaporation method and among them, the vacuum evaporation method is preferably used.

The CVD method is a method in which a raw gas (for example, a chloride) of a compound from which a protective layer is made is heated and decomposed to deposit a desired compound onto a substrate.

The sputter method is a method in which a compound from which a protective layer is made is sputtered by an inert gas to deposit a desired compound onto a substrate.

The evaporation method is a method in which a compound from which a protective layer is made is evaporated by heating with heating means such as an electron beam or the like to deposit a desired compound onto a substrate.

On the other hand, in the second gas discharge panel substrate assembly, the intermediate layer located between the dielectric layer and the protective layer is made of at least one compound compound selected from the group consisting of an Al compound, a Ti compound, an Y compound, a Zn compound, a Zr compound, a Ta compound and SiC, all having the ultraviolet shielding function. As concrete examples of the compounds, there are shown the same compounds as for the first gas discharge panel substrate assembly. Furthermore, similar to the first discharge panel substrate assembly, preferable are compounds having 6.2 eV or less in bandgap.

No specific limitation is imposed on a thickness of the intermediate layer as far as a prescribed function is exerted but it is preferably in the range of from 0.1 to 1 μm.

As methods for forming the intermediate layer, there are exemplified: a vacuum evaporation method, a CVD method, a plasma CVD method, a sol-gel method, a binder method and others.

The vacuum evaporation method is a method in which a compound from which an intermediate layer is made is heated and evaporated under a vacuum of $10^{-3}$ to $10^{-8}$ Torr with heating means such as an electron beam to deposit a desired compound onto a substrate.

The CVD method is a method in which a raw gas (for example, a chloride) of a compound from which an intermediate layer is made is heated and decomposed by heating to deposit a desired compound onto a substrate.

The plasma CVD method is a method in which a raw gas (for example, a chloride) of a compound from which an intermediate layer is made is decomposed with a plasma to deposit a desired compound onto a substrate.

The sol-gel method is a method in which a solution containing a fatty acid salt or an alkoxide of a compound from which an intermediate layer is made is coated on a substrate to bake a coat on the substrate and to thereby form the intermediate layer.

The binder method is a method in which a solution or a dispersion containing a compound from which an intermediate layer is made is coated on a substrate to bake a coat on the substrate and to thereby form the intermediate layer.

Note that in the second gas discharge panel substrate assembly, the protective layer, formed on the intermediate layer, and in contact with the discharge space is preferably made of MgO and a thickness thereof is preferably in the range of from 0.5 to 1.5 μm. Methods for forming the protective layer can be methods similar to the methods for use in the first gas discharge panel substrate assembly.

By imparting the protective layer the ultraviolet shielding function, the number of production steps can be decreased compared with a construction in which the intermediate layer has an ultraviolet shielding function and as a result, a tact is improved and a cost is reduced.

Structural members of the first and second gas discharge panel substrate assemblies other than the protective layer and the intermediate layer can be the same as each other.

No specific limitation is imposed on a substrate, but any of known substrates in the technical field pertaining to the present invention can be used. To be concrete, there are exemplified: transparent substrates such as a glass substrate and a plastic substrate.

No specific limitation is imposed on an electrode formed on a substrate, but any of known electrodes in the technical field pertaining to the present invention can be used. To be concrete, there are exemplified transparent electrodes such as ITO and NESA. Furthermore, a metal electrode made of Cr, Cu or a stacked structure thereof may be formed on a transparent electrode in order to reduce a resistance of the transparent electrode. An arrangement of electrodes are formulated ordinarily in an array of stripes on a substrate, though being different according to a kind of a gas discharge panel.

As the dielectric layer covering electrodes, no specific limitation is imposed on a dielectric layer but any of known dielectric in the technical field pertaining to the present invention can be used. To be concrete, there are exemplified: layers made of a low-melting glass and $SiO_2$.

The low-melting glass exemplified in the first place can be formed using a frit paste or a sheet frit. The frit paste can be obtained by adding an ethyl cellulose binder and a solvent (arbitrary) to a low-melting glass (frit glass). The frit paste is coated at a prescribed position with a printing method or the like to bake the coat and to thereby obtain the dielectric layer. A sheet frit can be obtained by adding an acrylic binder to frit glass to form a mixture in the shape of a sheet. The sheet frit is adhered onto a substrate and then the sheet is baked to thereby transform the sheet into the dielectric layer. The dielectric layer made of a low-melting glass ordinarily has a thickness in the range of from 15 to 35 μm.

$SiO_2$, which is exemplified in the second place, can be formed with a CVD method or a PECVD method. To be concrete, the $SiO_2$ dielectric layer can be formed such that, in a case of the PECVD method, a parallel plate type plasma CVD apparatus can be used to decompose a silane gas such as $SiH_4$ or $Si_2H_6$ or a silicon containing compound such as tetraorthoethyl silicate (TEOS) with a plasma generated under conditions of an RF output in the range of from 1 to 2 kW, a temperature in the range of from 300 to 400° C. and a pressure in the range of 1 to 3 in Torr. The $SiO_2$ dielectric layer also may be formed with an atmospheric CVD method. The dielectric layer made of $SiO_2$ ordinarily has a thickness in the range of from 5 to 15 μm.

Among the methods for forming the dielectric layer, preferable are a method forming a dielectric layer using a sheet frit and vapor phase methods such as a CVD method and a PECVD method because of the following reason and easiness in production.

In the dielectric layer formed with a sheet frit among the dielectric layers described above, since much of an organic component is contained in a sheet layer prior to the formation, it is inferred that a material having a hydrocarbon bond remains in the layer without burning out in baking. Furthermore, it is thought that in the vapor phase method, a material having bonds of silicon and/or carbon with hydrogen such as $SiH_4$ or $Si(OC_2H_5)_4$ is not all decomposed and partly remains unreacted in the formed film. It is thought that the material is decomposed by ultraviolet generated by discharge to release hydrocarbon or hydrogen gas, and the gas passes through a MgO layer and is released into a discharge space to degrade a phosphor. Furthermore, it is thought that since the gas is activated by discharge so as to have a reducing ability, the protective layer (MgO layer) is also reduced. The reduced protective layer is colored to degrade a transmittance. It is thought that with such results, a luminance is degraded during panel display to alter chromaticity. In the present invention, the ultraviolet shielding function is imparted to the protective layer of the first gas discharge panel substrate assembly and the intermediate layer of the second gas discharge panel substrate assembly. Therefore, it is prevented from occurring that ultraviolet generated in the discharge space reaches a dielectric layer, thereby enabling generation of hydrocarbon or hydrogen to be prevented.

Note that since even in a case where a frit paste is used as well, it is thought that a material having a hydrocarbon bond exists in the dielectric layer, a construction of the present invention is useful.

In formation of the protective layer, and intermediate layer and dielectric layer, all described above, the intermediate layer and the dielectric layer may be formed continuously with a CVD method or a plasma CVD method, and the intermediate layer and the protective layer may be formed continuously with a vacuum evaporation method. By forming continuously, reduction in production time can be achieved and mixing into of an impurity to layers can be prevented.

Description will be given of an example of a production method for a first gas discharge panel substrate assembly of the present invention below with reference to FIGS. 1(*a*) to 1(*d*). FIGS. 1(*a*) to 1(*d*) are schematic sectional views showing process steps from formation of the display electrodes (transparent electrodes and bus electrodes) to formation of a protective layer in the substrate side.

Transparent electrodes 31 are at first formed on a glass substrate (FIG. 1(*a*)), subsequent to this bus electrodes (for example, a three layer structure of Cr/Cu/Cr) 32 are formed (FIG. 1(*b*)) and display electrodes (also referred to as sustaining electrodes) 3 are thereby formed. The transparent electrodes and the bus electrodes can be formed with a known method.

Then, a dielectric layer 4 covering display electrodes 3 is formed (FIG. 1(*c*)). As methods for forming the dielectric layer 4, there are available a method in which a frit paste containing a frit glass or a sheet frit is used and a vapor phase method such as a CVD method.

A protective layer 12 having the ultraviolet shielding function is formed at a final stage (FIG. 1(*d*)). As methods for forming the protective layer 12, there can be used vapor phase film formation methods such as a CVD method, a vacuum or atmospheric evaporation method and a sputter method.

Figure 2:
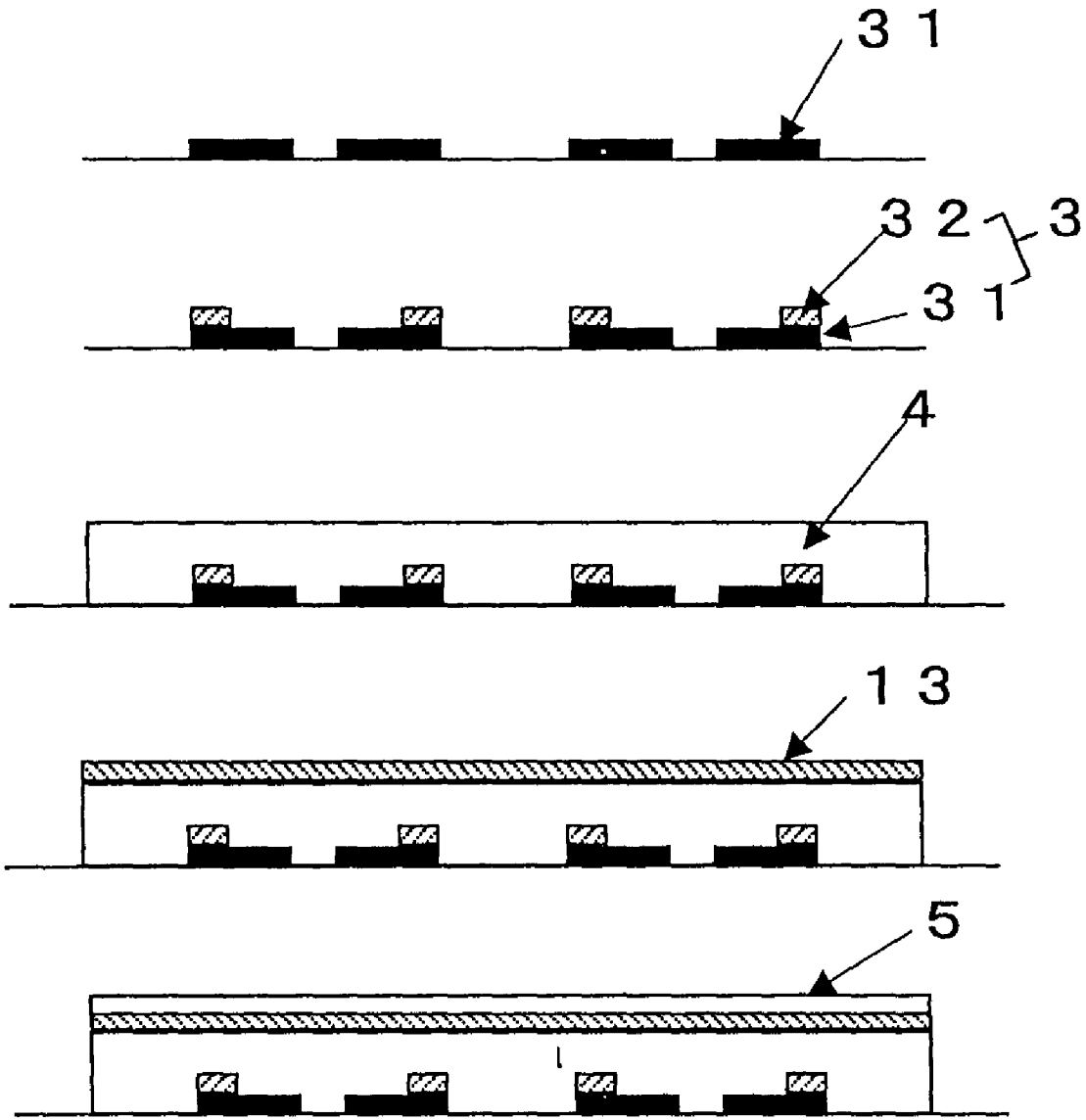
FIGS. 2(*a*) to 2(*e*) are schematic sectional views showing process steps from formation of the gas discharge panel substrate assembly of the present invention.

Then, description will be given of an example of a production method for a second gas discharge panel substrate assembly of the present invention below with reference to FIGS. 2(*a*) to 2(*e*). FIGS. 2(*a*) to 2(*e*) are schematic sectional views showing process steps from formation of display electrodes (a transparent electrodes and bus electrodes) to formation of a protective layer in the substrate side.

Transparent electrodes 31 are at first formed on a glass substrate (FIG. 2(*a*)), subsequent to this bus electrodes 32 are formed (FIG. 2(*b*)) and display electrodes (also referred to as sustaining electrodes) 3 are thereby formed. The transparent electrodes and bus electrodes can be formed with a known method.

Then, a dielectric layer 4 covering the display electrodes 3 is formed (FIG. 2(*c*)). As methods for forming the dielectric layer 4, there are available a method in which a frit paste containing a frit glass or a sheet frit is used and a vapor phase method such as a CVD method.

Then, an intermediate layer 13 having the ultraviolet shielding function is formed (FIG. 2(*d*)). As a method for forming the intermediate layer 13, there can be used: a vacuum evaporation method, a CVD method, a sol-gel method, or a binder method.

A protective layer 5 is formed at a final stage (FIG. 2(*e*)). As methods for forming the protective layer 5, there are generally exemplified: vapor phase methods such as an evaporation method, a sputter method and others.

Then, description will be given of a structure of a gas discharge panel (PDP) in a case where a gas discharge panel substrate assembly of the present invention is used in the front side below with reference to FIGS. 3 and 4.

Figure 3:
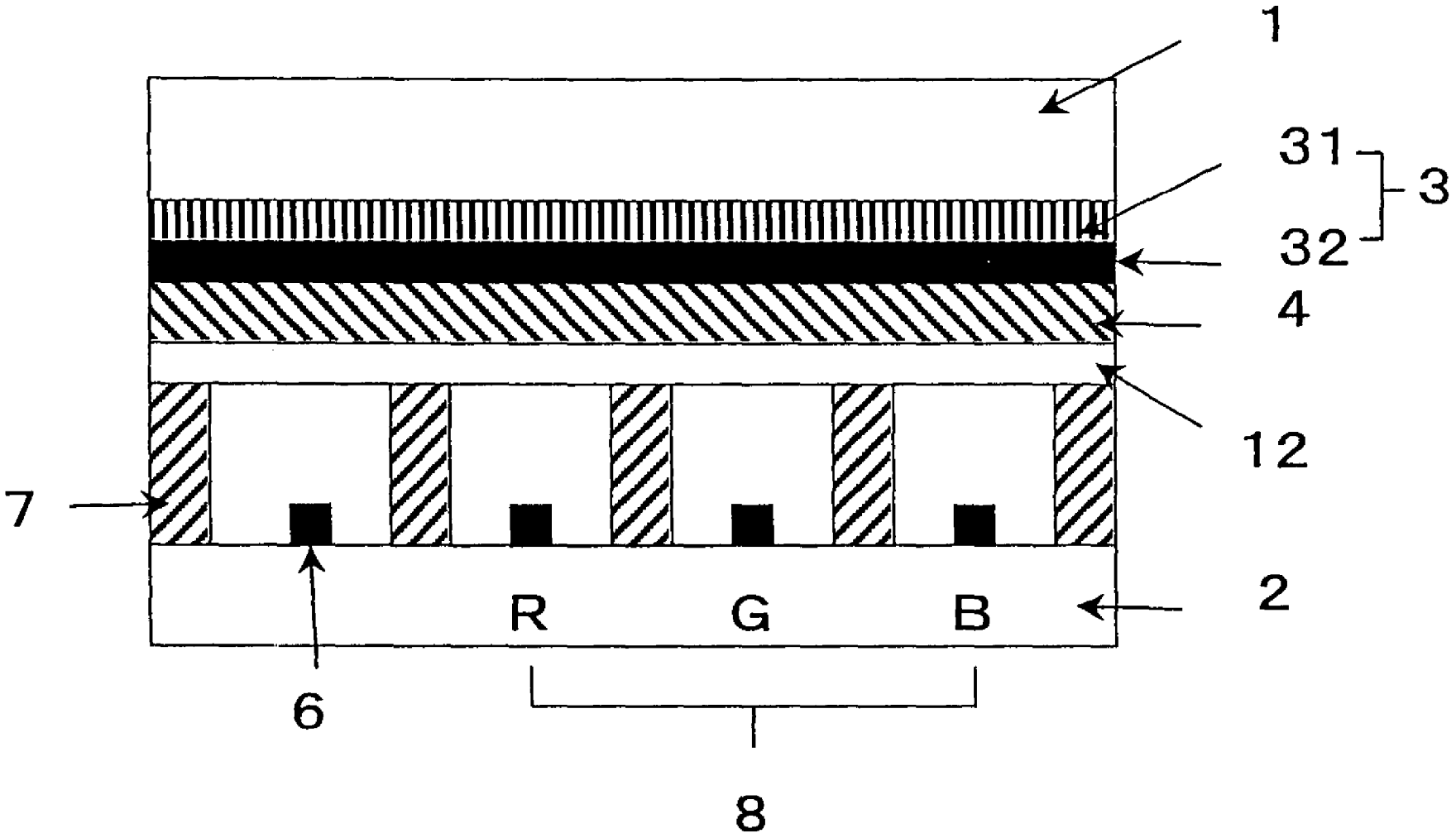
FIG. 3 is a schematic sectional view of the gas discharge panel of the present invention.
Figure 4:
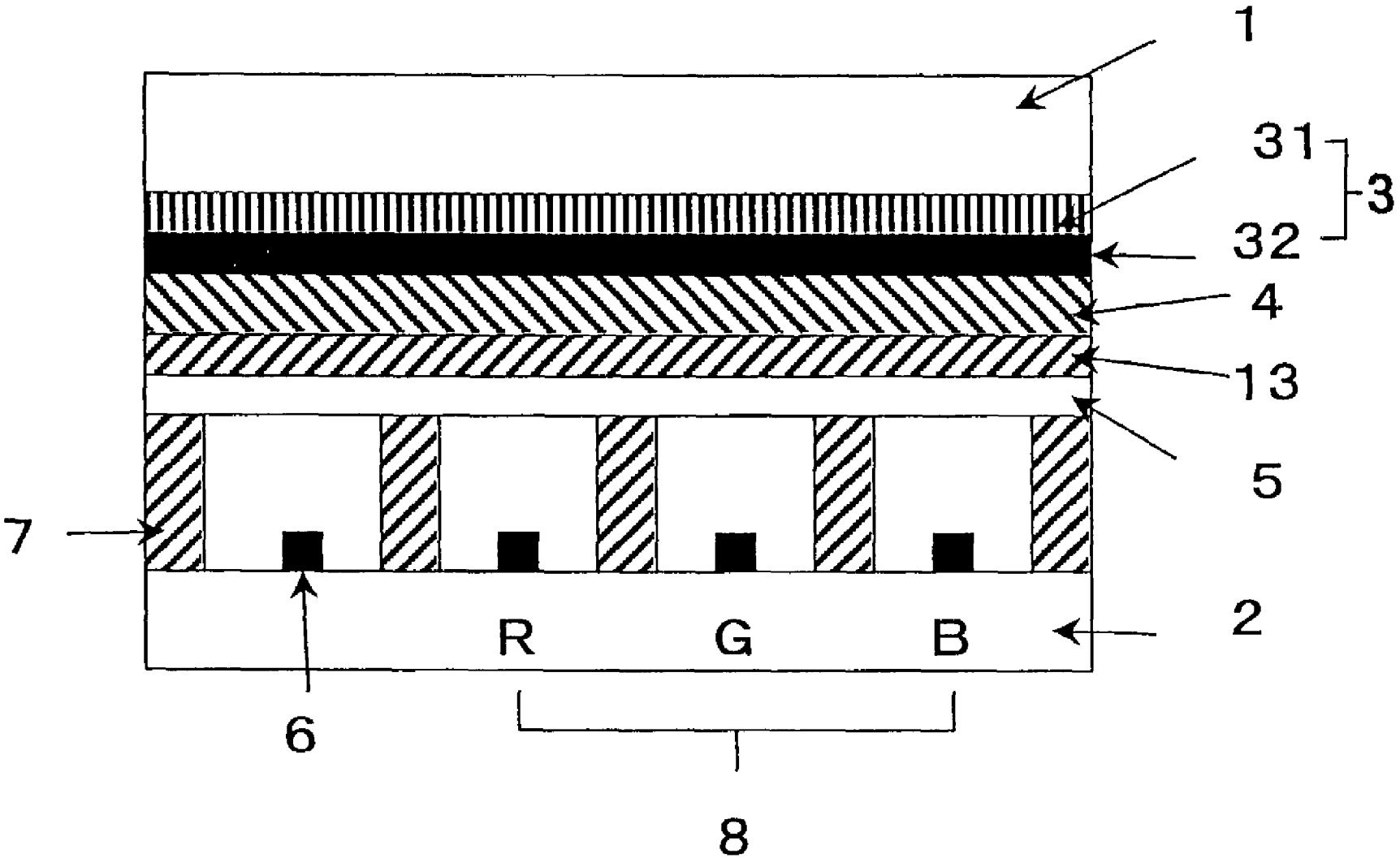
FIG. 4 is a schematic sectional view of the gas discharge panel of the present invention.
Figure 5:
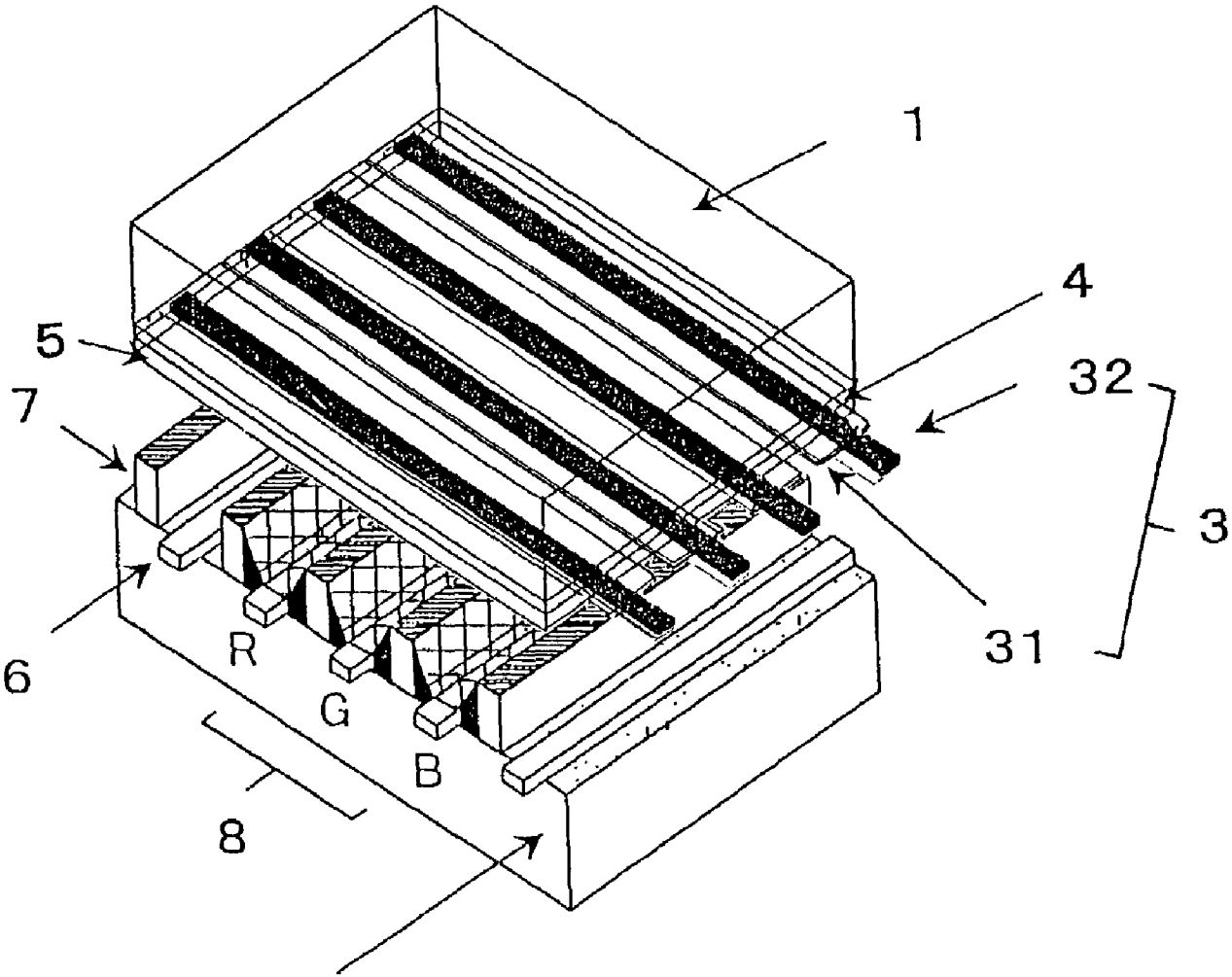
Fig.5 prior art
FIG. 5 is a schematic perspective view of a structure of a PDP of prior art.
Figure 6:
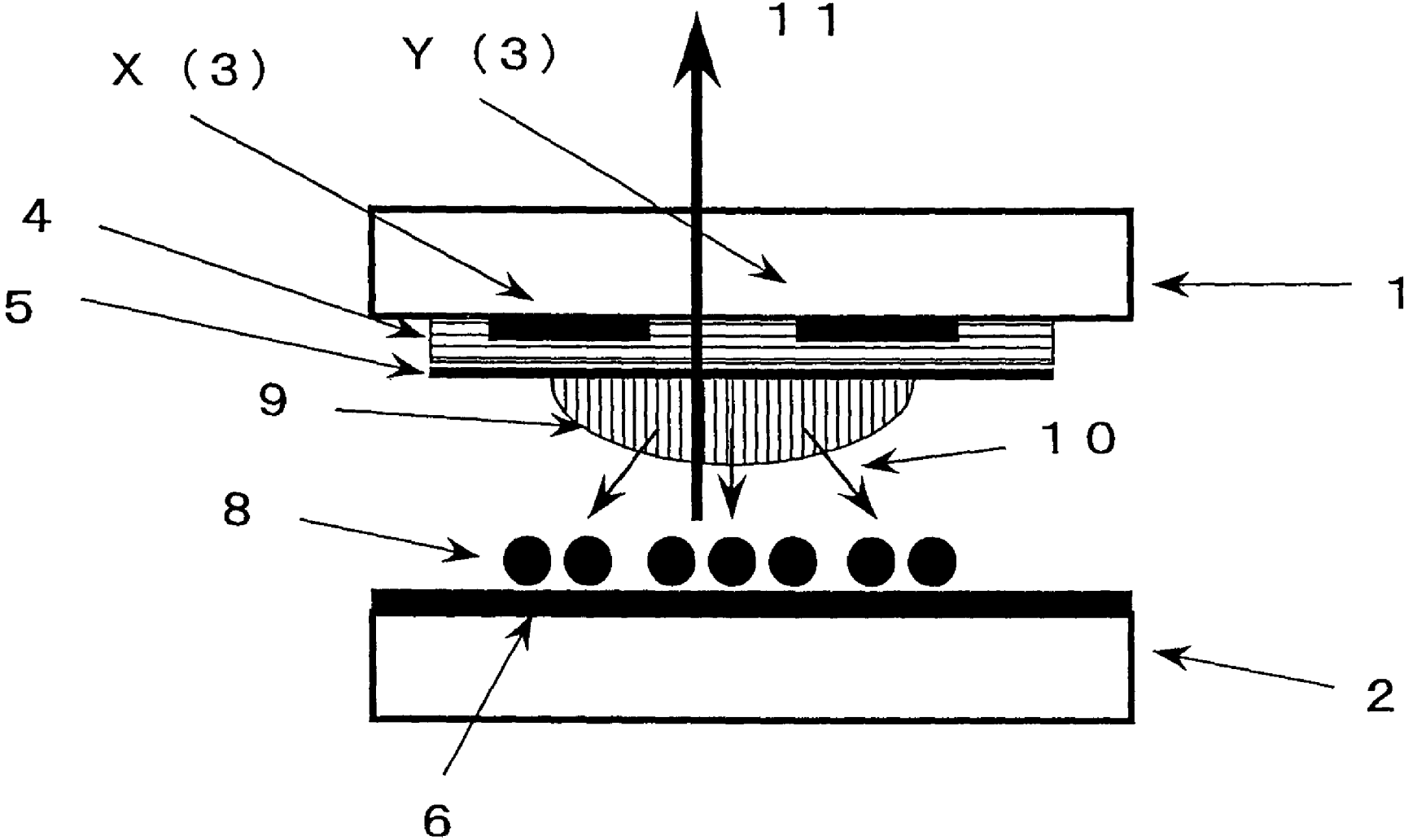
FIG. 6 is a schematic view of a state of a discharge panel in discharge.

PDPs of FIGS. 3 and 4 are three-electrode AC type surface discharge PDPs. The PDPs illustrate cases where, in each case, sub-pixels (discharge cells) are formed with barrier ribs arranged in an array of stripes. The PDP of FIG. 3 is a PDP in which the first gas discharge panel substrate assembly is used and the PDP of FIG. 4 is a PDP in which the second gas discharge panel substrate assembly is used.

The PDP of FIG. 3 is constituted of a front substrate and a back substrate.

The first gas discharge panel substrate assembly obtained in the process of FIG. 1 is used as the front substrate as it is.

Then, the back substrate is generally constituted of: plural address electrodes 6 each in the shape of a stripe formed on a back glass substrate 2; plural barrier ribs 7 each in the shape of a stripe formed on the back glass substrate 2 between the adjacent address electrodes 6; and phosphors 8 formed between the barrier ribs 7 and on rib surfaces thereof. In FIG. 3, the phosphors 8 include: phosphors for red (R), green (G) and blue (B).

Furthermore, the dielectric layer is formed on the back glass substrate 2 so as to cover the address electrodes 6 and the barrier ribs 7 may be formed on the dielectric layer. The dielectric layer can be formed in a similar way to that adopted in forming the dielectric layer in the front substrate side.

The PDP of FIG. 4 has one of features that an ultraviolet shielding function is not imparted to the protective layer, as in the PDP of FIG. 3, but the intermediate layer having an ultraviolet shielding function is formed between the protective layer and the dielectric layer. The PDP of FIG. 4 is the same as the PDP of FIG. 3 with the exception of this particular structure.

EXAMPLES

While description will be given of the present invention below with examples and comparative examples in a further concrete manner, no limitation is placed on conditions for forming a film, thickness values of films, materials and others used therein.

Example 1

A Dielectric Layer Constituted of a PECVD-$SiO_2$ and a Protective Layer having an Ultraviolet Shielding Function Constituted of Simultaneous Electron Beam Evaporation-MgO, and-$ZrO_2$, Alumina, Titania, $Y_2O_3$, ZnS, $Ta_2O_5$ or SiC Transparent electrodes and bus electrodes were formed on a substrate in the front side, thereafter in a parallel plate type plasma CVD apparatus, a dielectric layer made of $SiO_2$ was formed to a film thickness of 5 μm under conditions of $SiH_4$ at a flow rate of 900 sccm, $N_2O$ at a flow rate of 9000 sccm, an RF output at 2.0 kW, a temperature at 400° C. and a pressure at 3.0 Torr. Then, $ZrO_2$ and MgO were simultaneously deposited by electron beam evaporation to obtain a protective layer of a thickness of 1.0 μm. Thereafter, a PDP with the following specifications was fabricated by an ordinary process, followed by a display quality test on the PDP.

Specifications of the PDP a screen size: 42 inch
the number of pixels: 852×480 (VGA)
the number of sub-pixels: 2556×480
a sub-pixel size: 1080 μm×390 μm
material of front substrate: soda lime glass
thickness of front substrate: 3 mm
width of transparent electrode: 275 μm
width of bus electrode: 100 μm
surface discharge gap: 100 μm
width of light shielding layer between transparent electrodes: 350 μm
width of barrier rib: 70 μm
height of barrier rib: 140 μm
barrier rib pitch: 360 μm
kinds of phosphors: PDP standard RGB phosphors, red (Y, Gd)$BO_3$: Eu, green $Zn_2SiO_4$:Mn, blue $BaMgAl_{10}O_{17}$:Eu
driving conditions: 25 kHz at 180 V Display Quality Test White display at a load ratio of 10% is measured with a luminance meter BM7 made by TOPCON CORPORATION.

As a result of the test, chromaticity coordinates in the CIE standard colorimetric system were (0.300, 0.301) and anomaly in chromaticity was suppressed.

Furthermore, PDPs were fabricated in specifications and conditions similar to those described above with the exception that $ZrO_2$ was substituted for alumina, titania, $Y_2O_3$, ZnS, $Ta_2O_5$ or SiC. Coordinates of chromaticity of obtained PDPs are (0.301, 0.298), (0.301, 0.298), (0.303, 0.298), (0.302, 0.298), (0.300, 0.300) and (0.302, 0.298), which showed that degradation was suppressed.

Example 2

A Dielectric Layer Constituted of a PECVD-$SiO_2$ and an Intermediate Layer Constituted of Electron Beam Evaporation-$ZrO_2$, Alumina, Titania, $Y_2O_3$, ZnS, $Ta_2O_5$ or SiC Transparent electrodes and bus electrodes were formed on a substrate in the front side, thereafter in a parallel plate type plasma CVD apparatus, a dielectric layer made of $SiO_2$ was formed to a film thickness of 5 μm under conditions of $SiH_4$ at a flow rate of 900 sccm, $N_2O$ at a flow rate of 9000 sccm, an RF output at 2.0 kW, a temperature at 400° C. and a pressure at 3.0 Torr. Then, an intermediate layer made of $ZrO_2$ was deposited by electron beam evaporation to a thickness of 0.3 μm. Subsequent to this a protective layer made of MgO is evaporation deposited to a thickness of 1.0 μm. Thereafter, a PDP was fabricated in specifications and conditions similar to those adopted in Example 1, followed by a display quality test on the PDP. As a result of the test, chromaticity coordinates were (0.301, 0.302), which showed that anomaly in chromaticity was suppressed.

Furthermore, PDPs were fabricated in specifications and conditions similar to those described above with the exception that intermediate layers were made of alumina, titania, $Y_2O_3$, ZnS, $Ta_2O_5$ and SiC respectively. Chromaticity coordinates were (0.302, 0.299), (0.302, 0.299), (0.301, 0.298), (0.301, 0.299), (0.300, 0.300) and (0.301, 0.299), which showed that degradation was suppressed.

Example 3

A Dielectric Layer Constituted of a PECVD-$SiO_2$ and an Intermediate Layer Constituted of a Binder Method Titania-$TiO_2$ Transparent electrodes and bus electrodes were formed on a substrate in the front side, thereafter in a parallel plate type plasma CVD apparatus, a dielectric layer made of $SiO_2$ was formed to a film thickness of 5 μm under conditions of $SiH_4$ at a flow rate of 900 sccm, $N_2O$ at a flow rate of 9000 sccm, an RF output at 2.0 kW, a temperature at 400° C. and a pressure at 3.0 Torr. Then, titania powder of 0.5 μm in average particle diameter was dispersed in a binder composed of 5 wt % ethylcellulose and 95 wt % terpineol, a coat was applied on the dielectric layer by a printing method, thereafter the coat was baked in the atmosphere at 400° C. for 30 min to form an intermediate layer made of $TiO_2$ with a thickness of 3.0 μm. Subsequent to this a protective layer made of MgO layer was deposited by evaporation to a thickness of 1.0 μm. Thereafter, a PDP was fabricated in specifications and conditions similar to those adopted in Example 1, followed by a display quality test on the PDP. As a result of the test, chromaticity coordinates were (0.301, 0.299), which showed that anomaly in chromaticity was suppressed.

Example 4

A Dielectric Layer Constituted of a PECVD-$SiO_2$ and an Intermediate Layer Constituted of a Sol-Gel Method Titania-$TiO_2$ Transparent electrodes and bus electrodes were formed on a substrate in the front side, thereafter in a parallel plate type plasma CVD apparatus, a dielectric layer made of $SiO_2$ was formed to a film thickness of 5 μm under conditions of $SiH_4$ at a flow rate of 900 sccm, $N_2O$ at a flow rate of 9000 sccm, an RF output at 2.0 kW, a temperature at 400° C. and a pressure at 3.0 Torr. Then, $Ti(OC_2H_5)_4$ and 0.5% dilute hydrochloric acid were mixed in a molar ratio of 1 to 8, a reaction was performed therebetween for 30 min, thereafter the mixture was diluted with ethanol to a volume ten times the original, the diluted mixture was coated on the dielectric layer with a spin coat method to form a coat, thereafter the coat was baked in the atmosphere at 400° C. for 30 min to thereby form an intermediate layer made of $TiO_2$ of 3.0 μm in thickness. Subsequent to this a protective layer made of MgO layer was deposited by evaporation to a thickness of 1.0 μm. Thereafter, a PDP was fabricated in specifications and conditions similar to those adopted in Example 1, followed by a display quality test on the PDP. As a result of the test, chromaticity coordinates were (0.300, 0.299), which showed that anomaly in chromaticity was suppressed.

Example 5

A Dielectric Layer Constituted of a PECVD-$SiO_2$ and an Intermediate Layer Constituted of an Atmospheric CVD Titania of Isopropyl Titanate-$TiO_2$ Transparent electrodes and bus electrodes were formed on a substrate in the front side, thereafter in a parallel plate type plasma CVD apparatus, a dielectric layer made of $SiO_2$ was formed to a film thickness of 5 μm under conditions of $SiH_4$ at a flow rate of 900 sccm, $N_2O$ at a flow rate of 9000 sccm, an RF output at 2.0 kW, a temperature at 400° C. and a pressure at 3.0 Torr. Then, in an atmospheric CVD apparatus, an intermediate layer made of $TiO_2$ of 1.0 μm in thickness was formed under conditions of $Ti[COH(CH_3)_2]_4$ at a flow rate of 100 sccm, $O_2$ at a flow rate of 500 sccm and a substrate temperature at 400° C. Subsequent to this a protective layer made of MgO layer was deposited by evaporation to a thickness of 1.0 μm. Thereafter, a PDP was fabricated in specifications and conditions similar to those adopted in Example 1, followed by a display quality test on the PDP. As a result of the test, chromaticity coordinates were (0.301, 0.298), which showed that anomaly in chromaticity was suppressed.

Example 6

A Dielectric Layer Constituted of a PECVD-$SiO_2$ and an Intermediate Layer Constituted of an Atmospheric CVD Titania of Titanium Tetrachloride-$TiO_2$ Transparent electrodes and bus electrodes were formed on a substrate in the front side, thereafter in a parallel plate type plasma CVD apparatus, a dielectric layer made of $SiO_2$ was formed to a film thickness of 5 μm under conditions of $SiH_4$ at a flow rate of 900 sccm, $N_2O$ at a flow rate of 9000 sccm, an RF output at 2.0 kW, a temperature at 400° C. and a pressure at 3.0 Torr. Then, in an atmospheric CVD apparatus, an intermediate layer made of $TiO_2$ of 0.3 μm in thickness was formed under conditions of $TiCl_4$ at a flow rate of 100 sccm, $O_2$ at a flow rate of 500 sccm and a substrate temperature at 400° C. Subsequent to this a protective layer made of MgO layer was deposited by evaporation to a thickness of 1.0 μm. Thereafter, a PDP was fabricated in specifications and conditions similar to those adopted in Example 1, followed by a display quality test on the PDP. As a result of the test, chromaticity coordinates were (0.301, 0.298), which showed that anomaly in chromaticity was suppressed.

Example 7

A Dielectric Layer Constituted of a PECVD-$SiO_2$ and an Intermediate Layer Constituted of an Atmospheric CVD of Zirconium Tetrachloride-$ZrO_2$ Transparent electrodes and bus electrodes were formed on a substrate in the front side, thereafter in a parallel plate type plasma CVD apparatus, a dielectric layer made of $SiO_2$ was formed to a film thickness of 5 μm under conditions of $SiH_4$ at a flow rate of 900 sccm, $N_2O$ at a flow rate of 9000 sccm, an RF output at 2.0 kW, a temperature at 400° C. and a pressure at 3.0 Torr. Then, in an atmospheric CVD apparatus, an intermediate layer made of $ZrO_2$ of 0.3 μm in thickness was formed under conditions of $ZrCl_4$ at a flow rate of 100 sccm, $O_2$ at a flow rate of 500 sccm and a substrate temperature at 480° C. Subsequent to this a protective layer made of MgO layer was deposited by evaporation to a thickness of 1.0 μm. Thereafter, a PDP was fabricated in specifications and conditions similar to those adopted in Example 1, followed by a display quality test on the PDP. As a result of the test, chromaticity coordinates were (0.301, 0.299), which showed that anomaly in chromaticity was suppressed.

Example 8

A Dielectric Layer Constituted of a PECVD-$SiO_2$ and an Intermediate Layer Constituted of a Plasma CVD Alumina-$Al_2O_3$ Transparent electrodes and bus electrodes were formed on a substrate in the front side, thereafter in a parallel plate type plasma CVD apparatus, a dielectric layer made of $SiO_2$ was formed to a film thickness of 5 μm under conditions of $SiH_4$ at a flow rate of 900 sccm, $N_2O$ at a flow rate of 9000 sccm, an RF output at 2.0 kW, a temperature at 400° C. and a pressure at 3.0 Torr and successively, in the same apparatus, an intermediate layer made of $Al_2O_3$ of 0.3 μm in thickness was formed under conditions of $AlCl_3$ at a flow rate of 100 sccm, $CO_2$ at a flow rate of 1000 sccm, $H_2$ at flow rate of 500 sccm, an RF output at 2.0 kW, a temperature at 400° C. and a pressure at 3.0 Torr. Subsequent to this a protective layer made of MgO layer was deposited by evaporation to a thickness of 1.0 μm. Thereafter, a PDP was fabricated in specifications and conditions similar to those adopted in Example 1, followed by a display quality test on the PDP. As a result of the test, chromaticity coordinates were (0.301, 0.300), which showed that anomaly in chromaticity was suppressed.

Example 9

A Dielectric Layer Constituted of a Sheet Frit-Low-Melting Glass and an Intermediate Layer Constituted of an Electron Beam Evaporation-$ZrO_2$ Transparent electrodes and bus electrodes were formed on a substrate in the front side, thereafter an acrylic binder was added to frit glass made of $PbO—B_2O_5—SiO_2$ to process the mixture into a sheet, the sheet was adhered onto the substrate and baked in a conveyor type baking furnace under a heating program of 240 min at 350° C. and thereafter 60 min at 600° C., thereby forming an dielectric layer of 30 μm in thickness. Then, an intermediate layer made of $ZrO_2$ was formed with electron beam evaporation to a thickness of 0.3 μm. Subsequent to this a protective layer made of MgO layer was deposited by evaporation to a thickness of 1.0 μm. Thereafter, a PDP was fabricated in specifications and conditions similar to those adopted in Example 1, followed by a display quality test on the PDP. As a result of the test, chromaticity coordinates were (0.301, 0.299), which showed that anomaly in chromaticity was suppressed.

Example 10

A Dielectric Layer Constituted of a PECVD-$SiO_2$ and an Intermediate Layer Constituted of an Electron Beam Evaporation-$ZrO_2$ Transparent electrodes and bus electrodes were formed on a substrate in the front side, thereafter in a parallel plate type plasma CVD apparatus, a dielectric layer made of $SiO_2$ was formed to a film thickness of 5 μm under conditions of TEOS at a flow rate of 800 sccm, $O_2$ at a flow rate of 2000 sccm, an RF output at 1.5 kW, a temperature at 350° C. and a pressure at 1.0 Torr. Note that dielectric layers formed on a silicon substrate and a soda lime substrate had stresses of −0.7E9 dyn/cm$^2$ and −1.9 dyn/cm$^2$, respectively. Thereafter an intermediate layer made of $ZrO_2$ was deposited to a thickness of 0.3 μm by electron beam evaporation. Subsequent to this a protective layer made of MgO layer was deposited by evaporation to a thickness of 1.0 μm.

Thereafter, a PDP was fabricated in specifications and conditions similar to those adopted in Example 1, followed by a display quality test on the PDP. As a result of the test, chromaticity coordinates were (0.301, 0.299), which showed that anomaly in chromaticity was suppressed.

Example 11

A Dielectric Layer Constituted of a CVD-$SiO_2$ and an Intermediate Layer Constituted of an Electron Beam Evaporation-$ZrO_2$ Transparent electrodes and bus electrodes were formed on a substrate in the front side, thereafter in an atmospheric CVD apparatus, a dielectric layer made of $SiO_2$ was formed to a film thickness of 5 μm under conditions of $SiH_4$ at a flow rate of 1000 sccm, $N_2O$ at a flow rate of 10000 sccm, and a temperature at 450° C. Note that dielectric layers formed on a silicon substrate and a soda lime substrate had stresses of +4E9 dyn/cm$^2$ and +2.3 dyn/cm$^2$, respectively. Thereafter an intermediate layer made of $ZrO_2$ was deposited to a thickness of 0.3 μm by electron beam evaporation. Subsequent to this a protective layer made of MgO layer was deposited by evaporation to a thickness of 1.0 μm.

Thereafter, a PDP was fabricated in specifications and conditions similar to those adopted in Example 1, followed by a display quality test on the PDP. As a result of the test, chromaticity coordinates were (0.301, 0.299), which showed that anomaly in chromaticity was suppressed.

Example 12

A Dielectric Layer Constituted of a CVD-$SiO_2$ and an Intermediate Layer Constituted of a Plasma CVD Tantalum Oxide-$Ta_2O_5$ Transparent electrodes and bus electrodes were formed on a substrate in the front side, thereafter in a parallel plate type plasma CVD apparatus, a dielectric layer made of $SiO_2$ was formed to a film thickness of 5 μm under conditions of $SiH_4$ at a flow rate of 900 sccm, $N_2O$ at a flow rate of 9000 sccm, an RF output at 2.0 kW, a temperature at 400° C. and a pressure at 3.0 Torr. Successively, in the same apparatus, an intermediate layer made of $Ta_2O_5$ of 0.2 μm in thickness was formed under conditions of $Ta(C_2H_5OH)_5$ at a flow rate of 200 sccm (supplied directly after evaporation), $O_2$ at a flow rate of 1000 sccm, an RF output at 2.0 kW, a temperature at 400° C. and a pressure at 4.0 Torr. Subsequent to this a protective layer made of MgO layer was deposited by evaporation to a thickness of 1.0 μm.

Thereafter, a PDP was fabricated in specifications and conditions similar to those adopted in Example 1, followed by a display quality test on the PDP. As a result of the test, chromaticity coordinates were (0.300, 0.300), which showed that anomaly in chromaticity was suppressed.

Note that, in the present invention, no specific limitation is imposed on the examples described above, but various modification or alterations can be included. For example, a structure can also be included in which a substrate provided with a dielectric layer, barrier ribs and phosphor layers thereon is arranged in the front side and a substrate provided with a protective layer and others thereon is arranged in the back side. Another structure can also be included in which address electrodes are covered with a dielectric layer, and barrier ribs and phosphor layers are formed on the dielectric layer, in which case a surface of the dielectric layer is desirably covered with an ultraviolet shielding film. Furthermore, the present invention can also be applied to two-electrode AC type opposite discharge PDP.

According to the present invention, by imparting a protective layer itself an ultraviolet shielding function or inserting an intermediate layer having an ultraviolet shielding function between a protective layer and a dielectric layer, vacuum ultraviolet generated during discharge is prevented from reaching the dielectric layer, thereby disabling disconnection of a hydrocarbon bond in the dielectric layer. Therefore, since suppression can be realized of reduction of phosphor and the protective layer caused by hydrogen generated by the disconnection, there can be obtained a gas discharge panel without degradation of phosphor.

What is claimed is:

1. A gas discharge panel substrate assembly comprising:

electrodes formed on a substrate, a dielectric layer covering the electrodes, and a protective layer covering the dielectric layer and in contact with a discharge space, wherein the protective layer includes MgO and at least one compound selected from the group consisting of an Al compound, a Y compound, a Ti compound, a Zn compound, a Zr compound, a Ta compound and SiC, and has an ultraviolet shielding function, and the dielectric layer is a $SiO_2$ film, having bonds of hydrogen with silicon as a residual in the film, of a thickness in a range of 5 to 15 μm.

2. A gas discharge panel substrate assembly of claim 1, wherein the protective layer comprises a layer which shields the dielectric layer of the $SiO_2$ film from light having a wavelength of 200 nm or less generated by a discharge in the discharge space.

3. A gas discharge panel substrate assembly of claim 1, wherein said at least one compound is a compound having a bandgap of 6.2 eV.

4. A gas discharge panel substrate assembly of claim 1, wherein the dielectric layer contains a hydrocarbon bond therein.

5. A gas discharge panel substrate assembly comprising:

electrodes formed on a substrate, a dielectric layer formed on the substrate so as to cover the electrodes and made of a $SiO_2$ film, having bonds of hydrogen with silicon as a residual in the film, of a thickness in a range of 5 to 15 μm, an ultraviolet shielding layer formed on the dielectric layer and made of a compound having an ultraviolet shielding function to shield the dielectric layer from ultraviolet light generated by a discharge in a discharge space of the assembly, the compound being selected from the group consisting of an Al compound, a Y compound, a Ti compound, a Zn compound, a Zr compound, a Ta compound and SiC, and a protective layer formed on the ultraviolet shielding layer and made of MgO.

6. A gas discharge panel substrate assembly of claim 5, wherein the ultraviolet shielding layer shields the dielectric layer from ultraviolet light having a wavelength of 200 nm or less.

7. A gas discharge panel substrate assembly of claim 5, wherein the dielectric layer contains a hydrocarbon bond therein.

8. An AC type gas discharge panel comprising:

a front substrate having display electrodes;

a dielectric layer covering the display electrodes, the dielectric layer having a thickness in a range of 5 to 15 μm, and being a $SiO_2$ film having bonds of hydrogen with silicon as a residual therein;

a back substrate having a phosphor;

a discharge space between the front substrate and the back substrate and having a discharge gas sealed therein; and an ultraviolet shielding layer formed on the $SiO_2$ film and containing a compound which shields the $SiO_2$ film from ultraviolet light generated by a discharge in the discharge space and is selected from the group consisting of an Al compound, a Y compound, a Ti compound, a Zn compound, a Zr compound, a Ta compound and SiC.

9. An AC type gas discharge panel comprising:

a front substrate having display electrodes;

a dielectric layer covering the display electrodes, having a thickness in a range of 5 to 15 μm, and being a $SiO_2$ film having bonds of hydrogen with silicon as a residual therein;

a back substrate having a phosphor;

a discharge space between the front substrate and the back substrate and having a discharge gas sealed therein;

a protective layer covering a surface of the dielectric layer facing the discharge space and made of MgO; and an ultraviolet shielding layer formed between the $SiO_2$ film and the protective layer, wherein the ultraviolet shielding layer shields the dielectric layer from ultraviolet light generated by a discharge in the discharge space and contains a compound selected from the group consisting of an Al compound, a Y compound, a Zn compound, a Zr compound, a Ta compound and SiC.

10. A gas discharge panel substrate assembly comprising:

electrodes formed on a glass substrate;

a dielectric layer made of a sheet frit glass formed on the substrate by baking, being a $SiO_2$ film containing bonds of hydrogen with silicon as a residual therein, and having a thickness in a range of5to 15 μm;

an intermediate layer formed on the dielectric layer and shielding the dielectric layer from vacuum ultraviolet light generated by a discharge in a discharge space of the assembly, the intermediate layer being made of at least one compound selected from the group consisting of an Al compound, a Y compound, a Ti compound, a Zn compound, a Zr compound, a Ta compound and SiC; and a protective layer covering the intermediate layer and made of MgO.

11. A gas discharge panel substrate assembly of claim 10, wherein the intermediate layer is a $ZrO_2$ layer.

* * * * *

UNITED STATES PATENT AND TRADEMARK OFFICE

CERTIFICATE OF CORRECTION

PATENT NO. : 7,372,206 B2
APPLICATION NO. : 10/627727
DATED : May 13, 2008
INVENTOR(S) : Kazunori Inoue et al.

It is certified that error appears in the above-identified patent and that said Letters Patent is hereby corrected as shown below:

Column 16, Line 32, change “of5to” to --of 5 to--.

Signed and Sealed this

Twenty-third Day of September, 2008

JON W. DUDAS
*Director of the United States Patent and Trademark Office*